US009427651B2

(12) United States Patent
Hamada

(10) Patent No.: US 9,427,651 B2
(45) **Date of Patent: *Aug. 30, 2016**

(54) PUTTER ALIGNMENT GUIDE BAR

(71) Applicant: Sadao Hamada, Nankoku (JP)

(72) Inventor: Sadao Hamada, Nankoku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/293,253

(22) Filed: Jun. 2, 2014

(65) Prior Publication Data

US 2015/0343295 A1 Dec. 3, 2015

(51) Int. Cl.
*A63B 69/36* (2006.01)
*A63B 53/04* (2015.01)

(52) U.S. Cl.
CPC ..... *A63B 69/3685* (2013.01); *A63B 53/0487* (2013.01); *A63B 69/3658* (2013.01); *A63B 2053/0441* (2013.01); *A63B 2225/09* (2013.01)

(58) Field of Classification Search
CPC ..... A63B 69/3685; A63B 53/007; A63B 53/0487; A63B 2053/0441; A63B 69/3658; A63B 2225/09
USPC ..... 473/251, 252, 253, 254, 238, 242, 226, 473/341
See application file for complete search history.

(56) References Cited

U.S. PATENT DOCUMENTS 837,030 A 11/1906 Blanchard
D150,497 S * 8/1948 Forsell ..... 473/251
2,647,429 A * 8/1953 Smith ..... G10D 3/00 84/319
2,670,209 A * 2/1954 Fay ..... A63B 69/3685 33/286
3,198,525 A 8/1965 Smith
3,292,928 A 12/1966 Billen
3,298,693 A * 1/1967 Eisenberg ..... A63B 69/3632 473/238

(Continued)

FOREIGN PATENT DOCUMENTS

WO 0117621 3/2001
WO 2007094679 8/2007

*Primary Examiner* — Sebastiano Passaniti
(74) *Attorney, Agent, or Firm* — Schaffer IP Law, LLC

(57) ABSTRACT

A putting alignment apparatus comprises a vertical portion and a horizontal portion that may exist separately as an alignment device, or integrated within the putter itself. The vertical portion of the alignment apparatus is configured to be attached to the club head and sized to extend vertically above the height of a golf ball. The horizontal portion is coupled to an upper end of the vertical portion and sized to extend forwardly of the striking face when the putting alignment apparatus is attached to the club head. An alignment structure or aperture such as a slot is formed in the horizontal portion forwardly of the striking face, wherein a mark placed on the golf ball may be aligned with the structure or within the aperture to facilitate alignment of the golf club with the golf ball in a direction of intended movement.

11 Claims, 5 Drawing Sheets

(56) References Cited

U.S. PATENT DOCUMENTS

| | | | | | |
|---|---|---|---|---|---|
| 3,529,830 | A * | 9/1970 | Palotsee | A63B 69/3685 | 473/244 |
| 3,698,093 | A | 10/1972 | Marshall | | |
| 3,870,212 | A * | 3/1975 | Polk | B65H 35/0006 | 225/42 |
| 4,002,343 | A * | 1/1977 | Eckert | A63B 69/3685 | 473/251 |
| 4,209,172 | A * | 6/1980 | Yamamoto | A63B 69/3685 | 473/200 |
| 4,520,887 | A * | 6/1985 | DiFazio | H01M 2/1083 | 180/68.5 |
| 4,712,797 | A * | 12/1987 | Kovalchek | A63B 69/3685 | 473/251 |
| 4,953,867 | A * | 9/1990 | Rigsby | A63B 69/3685 | 473/238 |
| 5,362,058 | A * | 11/1994 | Honig | A63B 69/3685 | 473/251 |
| 5,368,267 | A * | 11/1994 | Howard | A47G 7/044 | 248/208 |
| 5,425,520 | A * | 6/1995 | Masumoto | A47B 96/06 | 248/188 |
| 5,538,249 | A | 7/1996 | Benson | | |
| 5,810,675 | A * | 9/1998 | Weathers | A63B 69/3685 | 473/236 |
| 6,422,949 | B1 * | 7/2002 | Byrne | A63B 69/3688 | 473/200 |
| 7,247,102 | B2 * | 7/2007 | Hayd | A63B 53/0487 | 473/236 |
| 7,341,526 | B2 | 3/2008 | McCarthy | | |
| 7,803,066 | B2 | 9/2010 | Solheim et al. | | |
| 7,815,515 | B1 | 10/2010 | Hunt | | |
| 7,905,793 | B2 | 3/2011 | O'Neill | | |
| 7,927,226 | B1 | 4/2011 | Twitty | | |
| 8,075,416 | B2 | 12/2011 | Stites et al. | | |
| 8,128,505 | B2 | 3/2012 | Tryner et al. | | |
| 8,308,583 | B2 | 11/2012 | Morris et al. | | |
| 8,616,992 | B2 | 12/2013 | Kim | | |
| 2005/0187028 | A1 | 8/2005 | Chang et al. | | |
| 2010/0190573 | A1 | 7/2010 | Boyd | | |

* cited by examiner

PUTTER ALIGNMENT GUIDE BAR

BACKGROUND OF THE INVENTION

This invention relates generally to golf putting aids and more particularly to simple and effective devices for increasing the accuracy of a golfer during the putting operation.

Putting is a very important part of the game of golf. Accurate putters are able to "read" the greens to determine conditions that will affect the roll of the golf ball toward the golf hole. Important conditions that affect the roll of the golf ball include the slope and topography of the path to the golf hole, the grass used on the putting surface, the condition of the grass (e.g. any bare spots), whether and in what direction the blades of grass are laying down, and whether and to what extent the grass is wet thus slowing down the roll of the golf ball. Other important aspects of putting include the distance to the hole and an estimate of how hard to strike the ball, and in what direction, given the conditions of the putt. For this later task, a golfer must correctly read the green to determine speed, topography, grain of the grass, moisture, etc. and determine where to aim, e.g. the initial direction where to start the ball rolling, not necessarily the golf hole but possibly left or right of the hole. The golfer must then align the putter so that the putter face is square to the initial putting direction. Finally, the golfer must execute the correct putting stroke whereby the putter travels parallel to the intended target (e.g. not coming from the outside or inside), the putter travels at the correct speed at impact, and the putter face is square at impact. The current invention assists with proper club alignment to accomplish this later task.

Given the low friction between the golf ball and the putter striking face, a struck golf ball generally travels perpendicular to the plane of the striking face of the club. It is therefore very important to line up the putter head with the golf ball with great precision so that the struck golf ball travels in the desired direction at the desired speed. Various methods have been developed to assist the golfer in lining up his putter with the golf ball including placing alignment marks on the top of the putter head directly behind the golf ball and marks or images in a structure behind the striking part of the club head. Not only are these methods getting more complicated, but are nearly impossible to retrofit onto an existing putter.

A need exists, therefore, for alternate means and structures that allow a golfer to align the club with marks placed on the golf ball itself where such means and structures may be retrofitted on to existing clubs.

SUMMARY OF THE INVENTION

A putting alignment apparatus is used with a golf club of a type having a club head with a striking face formed at a substantially vertical angle. The alignment apparatus comprises a vertical portion and a horizontal portion and may exist separately as an alignment device, or integrated within the putter itself. The vertical portion of the alignment apparatus is configured to be attached to the club head and sized to extend vertically above the height of a golf ball. The horizontal portion is coupled to an upper end of the vertical portion and sized to extend forwardly of and substantially perpendicular to a plane of the striking face when the putting alignment apparatus is attached to the club head. An alignment means, such as one or more aligned apertures or a slot, is formed in the horizontal portion so that it extends forwardly of the striking face, wherein a mark placed on the golf ball may be aligned with or within the aperture to facilitate alignment of the golf club with the golf ball in a direction of intended movement.

The putting alignment apparatus may include a structure that extends up and over a golf ball and includes alignment means structured to align with a mark made on the golf ball, wherein the alignment means is coupled to the head of the putter at a pivot axis parallel with a sole of the putter and/or the plane of the putting surface.

The invention further comprises a method for aligning a putter with a golf ball to improve putting accuracy. The method comprises placing a linear mark on a golf ball surface and placing the golf ball on a putting surface such that the linear mark points in the intended putting direction. A user then addresses the golf ball with a putter so that an alignment apparatus on the putter passes above and over the golf ball and the linear mark on the golf ball is aligned within an alignment structure, such as within a linear slot formed on the alignment apparatus. So aligned, the golf ball is then struck so that it moves in the intended putting direction.

When integrated within a golf club, the invention comprises a putter head having a forwardly directed striking face, an opposing putter back wall, and a bottom sole and further including an elongate shaft and a hosel affixing the putter head to the shaft. The integrated putter alignment apparatus in the club includes a vertical member attached to the putter back wall and extending upward a sufficient distance above the bottom sole of the putter to be higher than a golf ball to be struck by the putter. A horizontal member is attached to the vertical member at an upper end and extending forwardly of the striking face. An alignment structure, such as an aperture formed through the horizontal member, is aligned with a mark placed on the golf ball to be struck by the putter, wherein alignment of the mark with the structure or within the aperture from a point of view of a user of the putter facilitates alignment of the putter head with the golf ball so that the struck golf ball travels in an intended direction.

The foregoing and other objects, features and advantages of the invention will become more readily apparent from the following detailed description of a preferred embodiment of the invention that proceeds with reference to the accompanying drawings.

DETAILED DESCRIPTION

Figure 1:
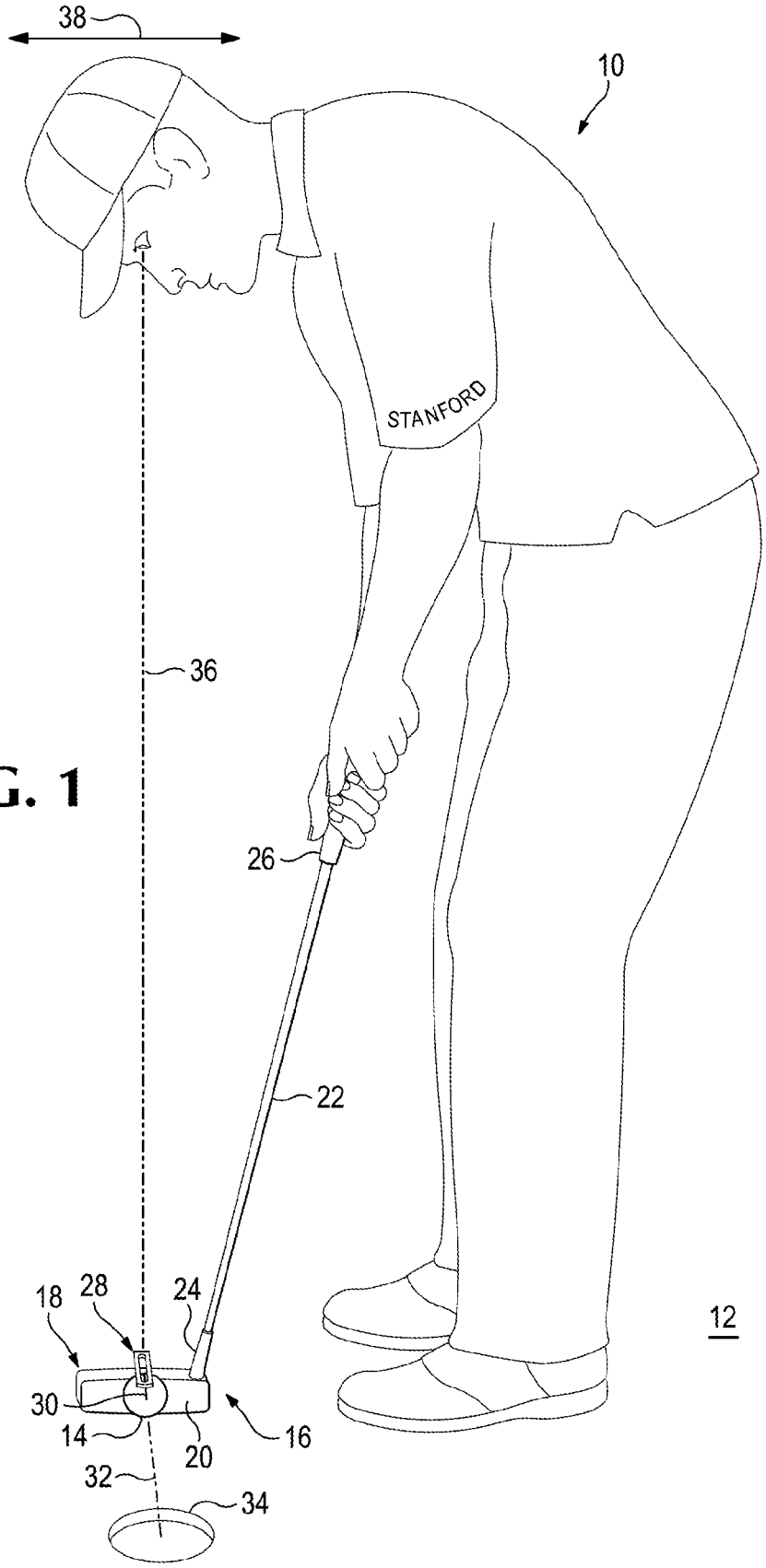
FIG. 1 is a perspective view of a golfer using the putter configured with an alignment guide bar according to a preferred embodiment of the invention.

FIG. 1 illustrates a golfer 10 standing on a putting surface 12 and addressing golf ball 14 with putter 16 in a putting stance. Putter 16 includes a club head 18 with a forward striking face 20 immediately adjacent to golf ball 14. Other parts of the putter include an elongate shaft 22, a hosel 24 coupling the club head 18 with the shaft 22, and a grip 26 grasped by the golfer 10 to swing the putter in an arc and strike the ball 14 with the striking surface 20 to propel the ball along a desired direction of travel 32. The hosel 24 is generally designed to incline the club head 18 from the shaft 22 at a predetermined angle so that a bottom surface/sole of the club head is generally parallel with the putting surface 12.

Putter 16 is fitted with an alignment bar 28 as constructed according to teachings of the invention and described further below. In generally use, the alignment bar 28 is coupled to the golf club head 18 so that it extends up and over the golf ball 14 and is aligned with an elongate mark 30 placed on the golf ball 14. The golf ball 14 is first placed on the putting surface 12 so that mark 30 is aligned with the intended direction of the travel 32 toward the golf cup or hole 34. The alignment bar 28 is then adjusted by methods and means that are described further below so that a site line 36 of the golfer 10 aligns a structure on the alignment bar with the mark 30 on the golf ball when the golfer is in his or her putting stance and addresses the golf ball. With the putter properly aligned with respect to the golf ball, the golf ball may be struck so that the ball moves in the intended putting direction 32. Whereas the intended putting directly is shown in FIG. 1 as directly toward the golf cup 34, it is understood that slope, grain, wind, and other factors may cause the golfer to aim to the side of the hole to anticipate any curving movement the ball may have on the way to cup.

When the putter is correctly aligned and the ball correctly struck, the ball will start rolling toward the intended target with the desired speed and desired rotation. The ball should be only imparted an over spin, absent of any side spin. When the ball mark 30 is struck perpendicular to the mark—e.g. so that the alignment means is perpendicular to the striking face and lined up with the ball mark—then the ball rolls the mark line 30 end over end. A properly aligned and struck ball will result in the golfer only seeing the mark trace a single straight line as the ball rolls. If the line wobbles or the golfer cannot see the line, then this is an indication that the ball may have been struck incorrectly in which case corrective measures can be made before the next putt. But a well struck ball never changes its course as long as the putting surface is flat and has no effects from other variables such as grain of the grass or wind.

Figure 7:
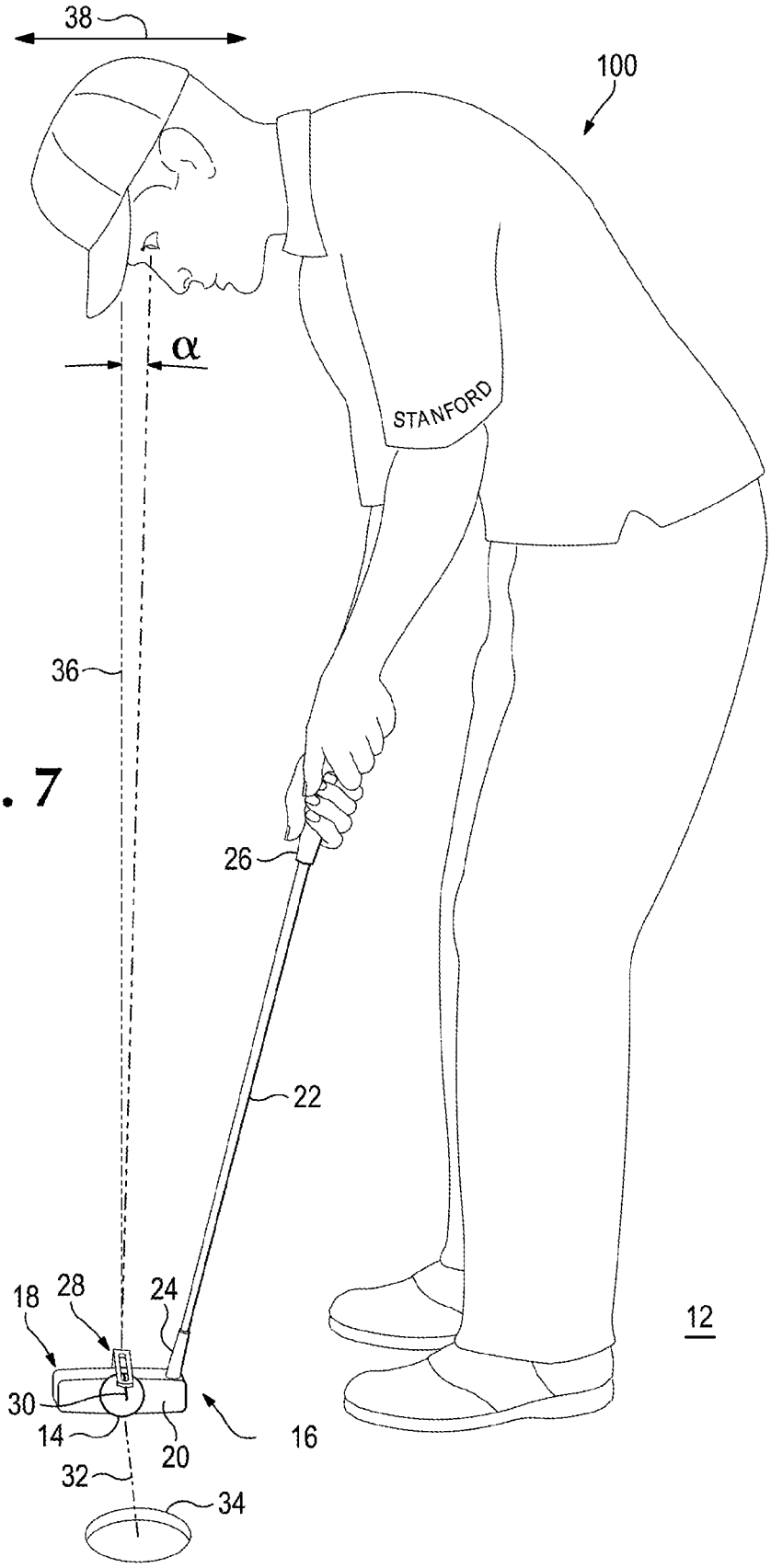
FIG. 7 is a perspective view of a golfer using the alignment guide bar of FIG. 1 but set up to accommodate where the golfer's eyes are closer to his body.

It is further understood that different golfers have different stances and methods for addressing the ball, and that while many position their heads so that their eyes are directly above the golf ball as shown in FIG. 1, other golfers stand so that their eyes are left or right 38 of the golf ball 14 and further from or closer to the golfer's feet. FIG. 7 illustrates the situation where a different golfer 100 sets up so that his eyes are not directly over the golf ball, but rather are inclined at an angle $\alpha$ from vertical so that his eyes are closer to the golfer's body. Because some golfers are not perfectly vertically aligned with the golf ball, it then becomes important to include adjustment means that allow the alignment bar 28 to move and/or tilt in the direction of alignment so that the eyes of the golfer, the alignment means, and the mark 30 on the golf ball 14 may all be properly aligned. In this instance, the alignment bar can be rotated along pin axis 62 to angle $\alpha$ from vertical so that it accommodates the golfer's stance and allows the ball mark 30 to be viewed through window 44.

Figure 2:
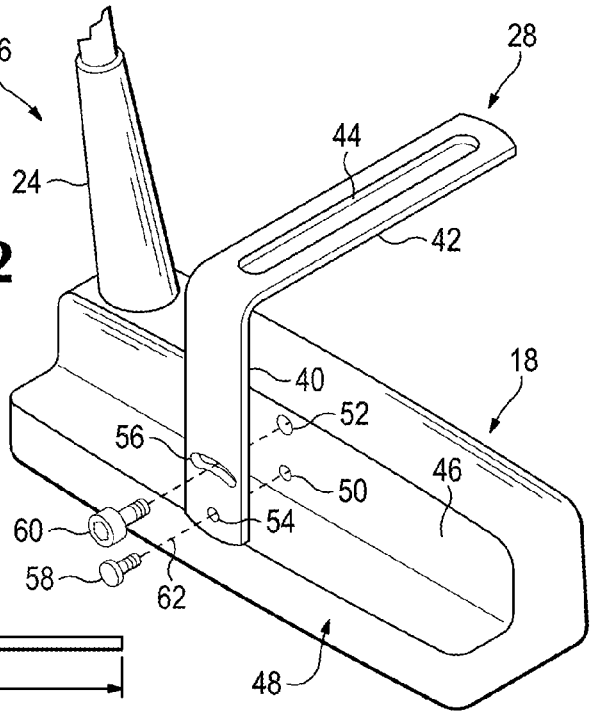
FIG. 2 is an exploded perspective view of the putter head and alignment bar of FIG. 1.
Figure 3:
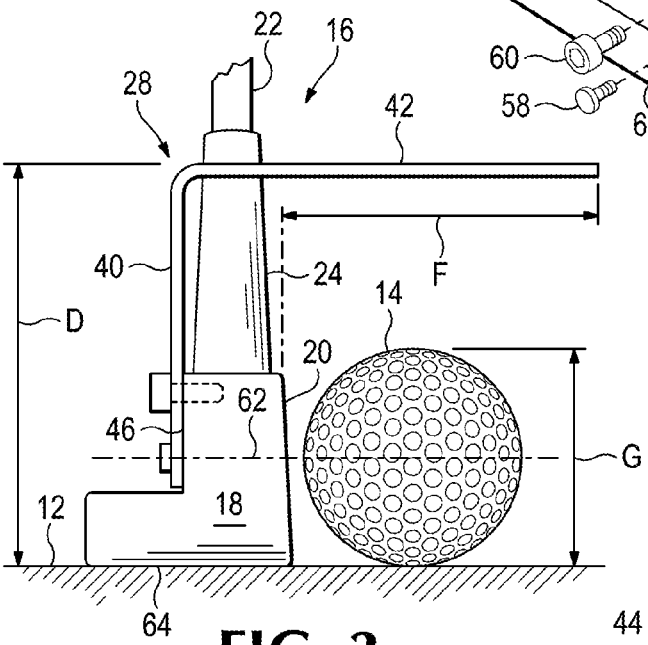
FIG. 3 is a side elevation view of the putter head and alignment bar next to a golf ball.
Figure 4:
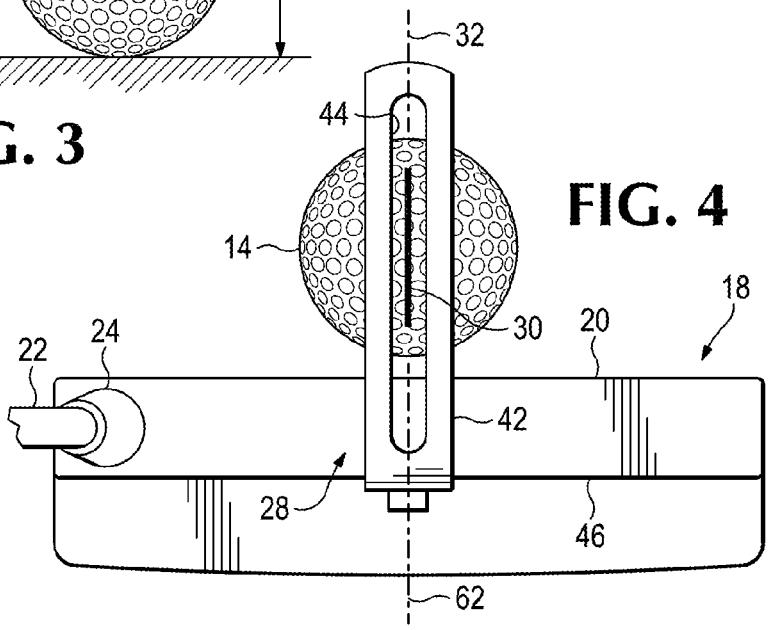
FIG. 4 is a top plan view of the putter head and alignment bar with the line mark on the golf ball centered within the alignment slot of the alignment bar.

FIG. 2 shows the putting alignment apparatus 28 detached from club head 18 in an exploded perspective view. The putting alignment apparatus 28 includes a vertical portion 40 that is configured to be attached to the club head 18 and sized to extend vertically above the putting surface a distance D, which is greater than a height G of a golf ball 14 (see, e.g., FIG. 3). Alignment apparatus 28 further includes a horizontal portion 42 coupled to an upper end of the vertical portion 40 and sized to extend forwardly F of the striking face 20 when the putting alignment apparatus 28 is attached to the club head 18 as shown in FIG. 3. In the embodiment shown, the vertical 40 and horizontal 42 portions are integrated together from a single metal bar bent at ninety degrees. In a preferred embodiment, the horizontal portion 42 is sized to extend forwardly of the golf ball when addressed as shown in FIGS. 3 and 4.

Alignment means or structure of the apparatus 28 can include an aperture, such as elongate slot 44, formed in the horizontal portion 42 forwardly of the striking face 20. As shown in FIG. 4, a mark 30 placed on the golf ball 14 may thus be aligned within the elongate slot 44 to facilitate alignment of the golf club 16 with the golf ball in a direction of intended travel 32. In a preferred embodiment, the elongate slot 44 is centrally formed along a long axis of the horizontal portion 42 of the putting alignment apparatus 28 and sized to capture at least the length of the golf ball.

Although such an alignment apparatus 28 can be integrated into a constructed putter (or other type of golf club), the apparatus can also be retrofitted onto an existing putter and preferably one with a generally vertical back wall 46. By way of example, and in no way intended to limit the applicability of the invention, the putter in FIG. 2 includes a weighted lower lip 48 to lower the center of gravity of the putter head 18. One understands, however, that other putter head shapes are contemplated and that the alignment apparatus and method can be used on most or all of these types.

The vertical member 40 of the alignment apparatus is coupled to the back wall 46 of putter 16. In a preferred embodiment, two threaded holes or apertures 50, 52 are formed horizontally into the back wall 46 of the putter. Lower aperture 50 is in vertically alignment with upper aperture 52. The vertical member 40 includes a first aperture 54 formed through a terminal end of the vertical portion, and a second aperture 56 spaced from the first aperture 54 in a vertical direction an identical distance as between the apertures 50, 52 in the putter back wall 46. The second aperture 56 includes an arcuate slot for limiting a pivot angle of the putting alignment apparatus as explained further below.

The vertical member 40 of alignment apparatus 28 is coupled to the putter head 18 via two pins or screws, such as screws 58, 60. A lower terminal end of the vertical member 40 is affixed to the putter head 18 via screw 58. Screw 58 is arranged to pass through apertures 50, 54 to form a pivot axis 62 that is parallel to the putting surface 12 (which itself is intended to be parallel to the sole 64 of the putter) and located along the rear vertical wall 46 of the putter head 18 to be approximately at or above the ball center height P (where P is approximately equal to ½ G).

A second portion of the alignment apparatus 28 is affixed to the vertical wall 46 of the putter head 18 via second screw 60. Second screw 60 passes through the arcuate slot 56 formed in the vertical member 40 of the alignment apparatus 28 and threads into the upper aperture 52 formed in the putter head 18 vertical wall 46. In use, the second screw 60 is loosened so that the alignment apparatus 28 can be pivoted about pivot axis 62. Once the site line 36 is properly angled so that the golf ball mark 30 is properly aligned within the alignment slot 44 as viewed from the golfer's point of view, the second screw 60 is tightened to thus fix the angle for future use. Alternate embodiments are contemplated for moving the alignment apparatus with respect to the club, for instance a structure that slide between the heel and toe of the club so that the horizontal member 42 is offset with respect to the ball mark 30, but maintains the mark 30 within the slot 44 of the horizontal member as viewed from the golfer's perspective.

Figure 5A:
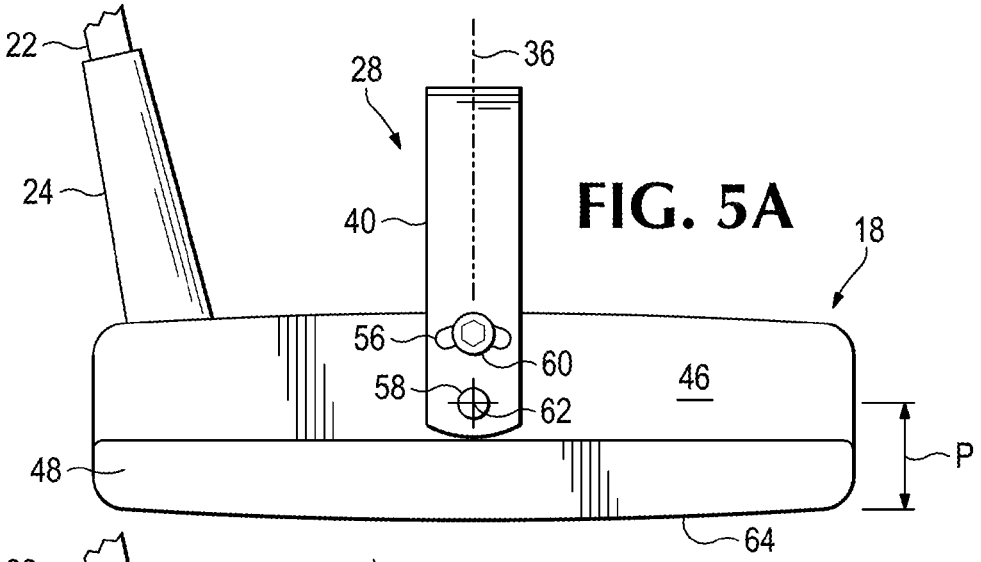
FIGS. 5A and 5B are rear elevation views of the putter head and alignment bar showing the alignment bar in an upright setting and in an inclined setting, respectively.
Figure 5B:
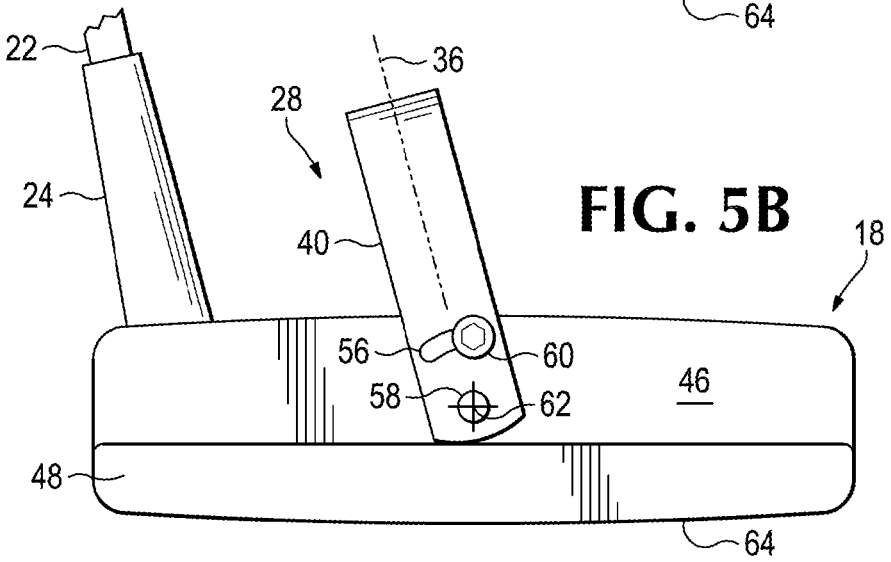

FIGS. 5A and 5B illustrate how the alignment apparatus 28 may be tilted in a plane substantially parallel with the putting face 20 of the putter and around pivot axis 62. FIG. 5A shows the alignment apparatus 28 in a fully upright position to accommodate a golfer 10 when positioned with his head directly above the golf ball as shown in FIG. 1. Screw 60 is shown centered within the arcuate slot 56. Alternatively, FIG. 5B shows the alignment apparatus 28 in a fully reclined position as limited by the stop on one side of the arcuate slot 56 where screw 60 is to one side of the slot and site line 36 is angled with the hosel 24 to accommodate a golfer 10 whose head is positioned closer to the golfers body and below the ball. The arcuate shape of slot 56 allows an infinite variation and selection of angles to accommodate golfers with a variety of stances, and adjustably fixes the pivot angle of the alignment apparatus to one of a plurality of selectable angles. When so moved, the alignment apparatus 28 is tilted to a desired angle so that the eyes of the user when addressing the ball center the mark 30 on the ball 14 within the linear slot 44.

It is not necessary that the pivot attachment point 58 be lower on the alignment apparatus 28 vertical portion 40 than the moving attachment point 56. The attachment points 56, 58 can be switched and still have a similar effect. Furthermore, it is possible that a single pivot attachment point can be used without the second point, although this runs a further risk of loosening over time and changing the preset tilt angle of the alignment apparatus.

Figure 6:
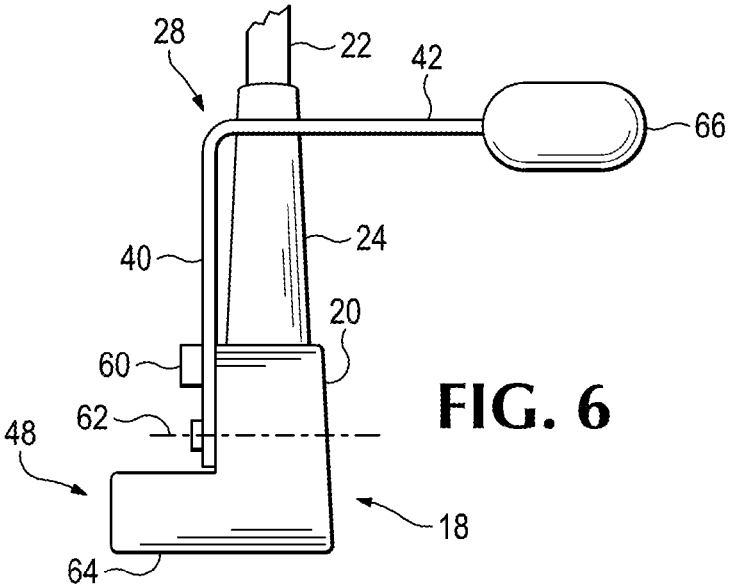
FIG. 6 is a side elevation view of an alternate embodiment of the putter head with alignment bar where a weight is attached to the front end of the alignment bar to move the center of gravity of the club toward the striking face of the putter.
Figure 9:
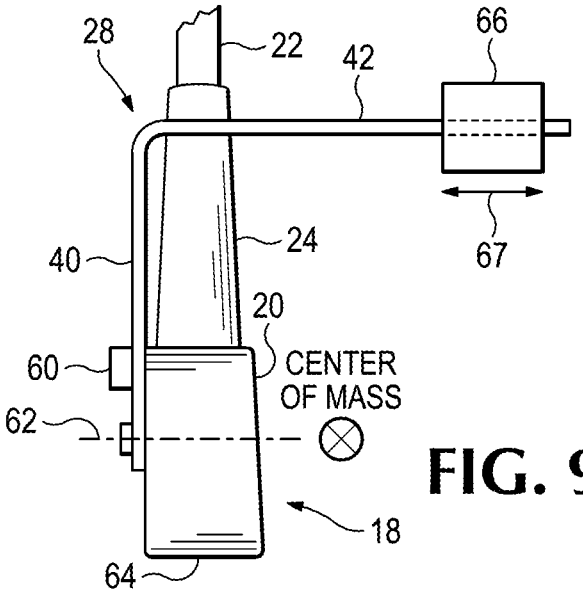
FIG. 9 is a side elevation view of yet another alternate embodiment of the putter head with alignment bar with adjustable weight portion.

FIG. 6 illustrates an alternate embodiment of the invention where the alignment apparatus 28 includes a weighted portion 66 affixed to a terminal end of the horizontal member 42 forwardly of the golf ball 14. The weight 66 is configured in mass and position so that it acts to move a center of mass of the club head 18 forwardly toward the striking face 20 of the golf club 16. In a most preferred embodiment, the weight is configured in mass and position to move the center of mass of the club head 18 in substantial alignment with or in front of the striking face 20 of the golf club 16. This weight changes the balance of a typical putter, where the center of mass is typically behind the striking face 20, to a position closer to the front where greater control over the swing may be realized. In one embodiment, such as shown in FIG. 9, the weight 66 may be moved 67 linearly along an axis of the horizontal member 42 and substantially perpendicular to a plane of the striking face 20 so that the center of mass may be adjusted forwardly of the striking face according to the golfer's preference. In another embodiment, the weight 66 may be detached and another weight of different size, density, and/or weight may be selected to impart a desired location to the center of mass.

FIG. 7 illustrates the alignment apparatus in use with a golfer 100 who sets up differently than the golfer shown in FIG. 1. The golfer 100 in FIG. 7 has his eyes closer to his body, thus resulting in a viewing angle to the golf ball 14 that varies at an inclined angle $\alpha$ from vertical. The alignment apparatus 28 can then be tilted toward the golfer to accommodate such a stance and so that the ball mark 30 aligns with or within the alignment structure or slot 44, respectively.

Figure 8:
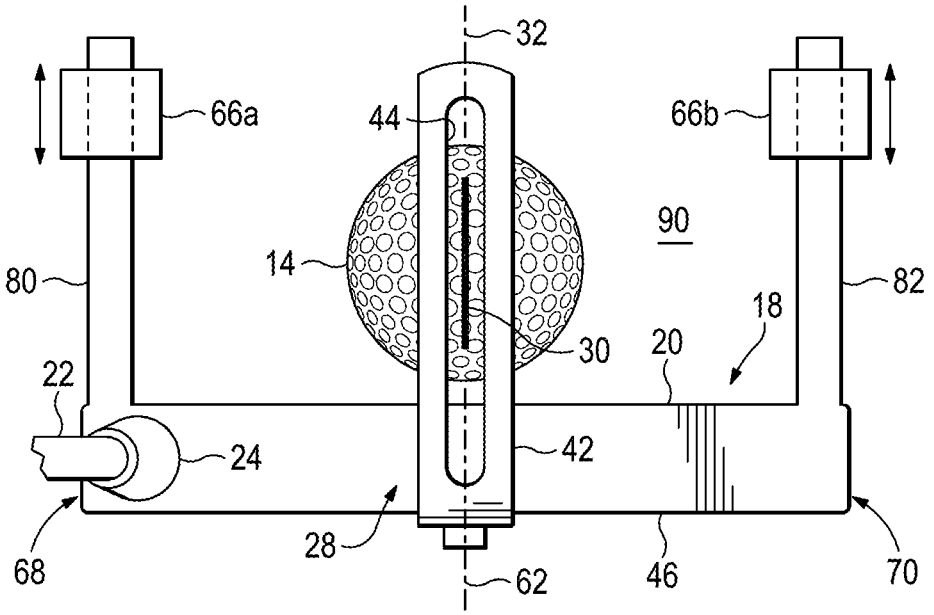
FIG. 8 is a top plan view of yet another embodiment of a putter with alignment guide bar with weighted portions extending forwardly at the heel and toe of the putter.

FIG. 8 illustrates an alternate embodiment of the putter whereby a first weighted structure 80 extends forwardly of the putter striking face 20 at a heel 68 of the putter and a second weighted structure 82 extends forwardly of the putter striking face at a toe 70 of the putter. The putter further includes weights 66*a*, 66*b* formed on terminal ends of the first and second weighted structures 80, 82, wherein said weights 66*a*, 66*b* are formed of a denser material than the putter head so that a center of gravity of the putter head moves in front of the striking face 20 of the putter. The weights 66*a*, 66*b* may be adjustable along the length of their respective weighted structures 80, 82 to adjust the position of the putter head center of mass to accommodate the preference of the golfer. Weighted structures 80, 82 may extend at a right angle to the striking face 20 of the putter or outwardly so that the golf ball 14 is aligned within the volume 90 between the structures 80, 82.

The putter head and various weights and structures can be formed of different materials to affect the putter head's center of mass. In one embodiment the putter head/blade 18 can be formed of a light carbon material whereas the weights formed on the tips of the weighted structures are formed of a heavier metal such as lead. The center of mass of the putter then moves forwardly of the striking face of the putter and within the alignment slot so that it centers along the ball mark. It is noted that to further facilitate movement of the center of mass forward, that the weighted lower lip 48 is removed from the putter head 18.

Alternate versions of the alignment means are contemplated. The alignment slot 44 on the horizontal member need not be a single aperture but can be several apertures formed along the axis of the horizontal member 42 of the alignment bar 28. The alignment means need not even include a slot or aperture, but rather include a straight edge that aligns with the mark on the ball and is pivotable in an axis parallel to the putting surface. Finally, it would be possible to include multiple alignment apparatus, such as on each side of the putter striking face 20—e.g. one on the toe, on in the middle, and one on the heel of the putter—which each align with different elements of the ball, the ball mark, or club face.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A putter with alignment apparatus comprising:

a putter head having a forwardly directed striking face, an opposing putter back wall, and a bottom sole;

an elongate shaft;

a hosel affixing the putter head to the shaft; and a putter alignment apparatus comprising:

a vertical member attached to the putter back wall and extending upward a sufficient distance above the bottom sole of the putter to be higher than a golf ball to be struck by the putter;

a horizontal member attached to the vertical member at an upper end and extending forwardly of the striking face;

an alignment structure formed in the horizontal member for aligning with a mark placed on the golf ball to be struck by the putter, wherein alignment of the mark with the alignment structure from a point of view of a user of the putter facilitates alignment of the putter head with the golf ball so that the struck golf ball travels in an intended direction; and means for tilting the vertical member in a plane substantially parallel with the striking face of the putter, wherein the means for tilting includes a pivot attachment point between the vertical member and the back wall of the putter head and a moving attachment point spaced from the pivot attachment point along the vertical member of the putter alignment apparatus for adjustably fixing a pivot angle of the alignment apparatus to one of a plurality of selectable angles.

2. The putter of claim 1, wherein the pivot attachment point includes an arcuate slot formed in the vertical member to define a pivot limit, a threaded aperture formed in the putter back wall and aligned within the arcuate slot, and a screw received within the arcuate slot and threaded aperture so that the putter alignment apparatus may be pivoted when the screw is loosened and fixed to a desired pivot angle when tightened.

3. A putter with alignment apparatus comprising:

a putter head having a forwardly directed striking face, an opposing putter back wall, and a bottom sole;

an elongate shaft;

a first weighted structure extending forwardly of the putter striking face at a heel of the putter and a second weighted structure extending forwarding of the putter striking face at a toe of the putter;

a hosel affixing the putter head to the shaft; and a putter alignment apparatus comprising:

a vertical member attached to the putter back wall and extending upward a sufficient distance above the bottom sole of the putter to be higher than a golf ball to be struck by the putter;

a horizontal member attached to the vertical member at an upper end and extending forwardly of the striking face;

an alignment structure formed in the horizontal member for aligning with a mark placed on the golf ball to be struck by the putter, wherein alignment of the mark with the alignment structure from a point of view of a user of the putter facilitates alignment of the putter head with the golf ball so that the struck golf ball travels in an intended direction.

4. The putter of claim 3, further including weights formed on terminal ends of the first and second weighted structures, wherein said weights are formed of a denser material than the putter head so that a center of gravity of the putter head moves in front of the striking face of the putter.

5. A putter with alignment apparatus comprising:

a putter head having a forwardly directed striking face, an opposing putter back wall, and a bottom sole;

an elongate shaft coupled to the putter head; and a putter alignment apparatus comprising:

a vertical member attached to the putter back wall and extending upward a sufficient distance above the bottom sole of the putter to be higher than a golf ball to be struck by the putter;

a horizontal member attached to the vertical member at an upper end and extending forwardly of the striking face; and an alignment structure formed in the horizontal member directly over the golf ball for aligning immediately adjacent and along an elongate mark placed on the golf ball, wherein alignment of the mark with the alignment structure from a point of view of a user of a user facilitates alignment of the putter head with the golf ball so that the struck golf ball travels in an intended direction, wherein the alignment structure is an elongate slot configured to expose only that portion of the golf ball having the elongate mark when the alignment apparatus is properly aligned with the golf ball;

pivot means for pivoting the vertical member in a plane substantially parallel with the striking face of the putter head, wherein the pivot means including a first aperture formed through a terminal end of the vertical member for affixing the putting alignment apparatus in pivot relationship to the back wall of the putter.

6. The putter of claim 5, further including a second aperture spaced from said first aperture in said vertical portion, said second aperture having an arcuate slot for limiting a pivot angle of the putting alignment apparatus.

7. The putter of claim 6, wherein the first aperture is lower than the second aperture.

8. The putter of claim 6, wherein the first aperture is above the second aperture.

9. The putter of claim 5, wherein the alignment structure is an elongate slot configured to expose only that portion of the golf ball having the elongate mark when the alignment apparatus is properly aligned with the golf ball.

10. A putter with alignment apparatus comprising:

a putter head having a forwardly directed striking face, an opposing putter back wall, and a bottom sole;

an elongate shaft coupled to the putter head; and a putter alignment apparatus comprising:

a vertical member attached to the putter back wall and extending upward a sufficient distance above the bottom sole of the putter to be higher than a golf ball to be struck by the putter;

a horizontal member attached to the vertical member at an upper end and extending forwardly of the striking face; and an alignment structure formed in the horizontal member directly over the golf ball for aligning immediately adjacent and along an elongate mark placed on the golf ball, wherein alignment of the mark with the alignment structure from a point of view of a user of a user facilitates alignment of the putter head with the golf ball so that the struck golf ball travels in an intended direction, further including a weight positioned on a terminal end of the horizontal member and configured to move a center of mass of the club head forwardly toward the striking face of the putter.

11. The putter of claim 10, wherein the weight is sized and weighted to move the center of mass of the putter in substantial alignment with or in front of the striking face of the golf club.

* * * * *